US009660400B2

(12) United States Patent
Cheng et al.

(10) Patent No.: US 9,660,400 B2
(45) Date of Patent: May 23, 2017

(54) FLIPPABLE ELECTRICAL CONNECTOR

(71) Applicant: FOXCONN INTERCONNECT TECHNOLOGY LIMITED, Grand Cayman (KY)

(72) Inventors: Chih-Pi Cheng, New Taipei (TW); Chun-Chieh Yang, New Taipei (TW); Tzu-Yao Hwang, New Taipei (TW); Wen He, Shenzhen (CN); Feng Zeng, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/292,138

(22) Filed: Oct. 13, 2016

(65) Prior Publication Data

US 2017/0033520 A1 Feb. 2, 2017

Related U.S. Application Data

(63) Continuation-in-part of application No. 15/169,004, filed on May 31, 2016, which is a continuation-in-part
(Continued)

(30) Foreign Application Priority Data

Jun. 18, 2015 (CN) ..... 2015 1 0339562

(51) Int. Cl.
*H01R 24/00* (2011.01)
*H01R 24/60* (2011.01)
(Continued)

(52) U.S. Cl.
CPC ..... *H01R 24/60* (2013.01); *H01R 13/405* (2013.01); *H01R 2107/00* (2013.01)

(58) Field of Classification Search
CPC ..... H01R 23/7073; H01R 23/7005
(Continued)

(56) References Cited

U.S. PATENT DOCUMENTS 6,755,689 B2 6/2004 Zhang et al.
7,758,379 B2 7/2010 Chen
(Continued)

FOREIGN PATENT DOCUMENTS

CM CN201868687 U 6/2011
CN 1253402 A 5/2000
(Continued)

OTHER PUBLICATIONS

Universal Serial Bus Type-C Cable and Connector Specification Revision 0.7 Working Draft Jan. xx, 2014, p. 13-14,20-21,33,38.
(Continued)

*Primary Examiner* — Phuongchi T Nguyen
(74) *Attorney, Agent, or Firm* — Wei Te Chung; Ming Chieh Chang

(57) ABSTRACT

A plug connector includes a connector body defining a rear cable supporting platform with opposite first and second surfaces, a plurality of terminals and a cable. The terminal includes a pair of USB 2.0 signal soldering legs, a grounding and power soldering legs exposed to the first surface of the supporting platform and a detecting soldering leg, an additional power and grounding soldering legs exposed to the second surface. Wires of the cable consist of a pair of USB 2.0 signal wires, a power wire, a grounding wire welded with corresponding soldering legs on the first surface. The second surface of the supporting platform is further located with a SMT type resistor with a first leg and a second leg, the first leg is connected with the detecting soldering leg, the second leg is connected with the additional power soldering leg or the additional grounding soldering leg.

7 Claims, 8 Drawing Sheets

Related U.S. Application Data of application No. 14/698,876, filed on Apr. 29, 2015, now Pat. No. 9,356,400, and a continuation-in-part of application No. 14/667,632, filed on Mar. 24, 2015, said application No. 14/698,876 is a continuation-in-part of application No. 14/558,732, filed on Dec. 3, 2014, now Pat. No. 9,490,594, application No. 15/292,138, which is a continuation-in-part of application No. 14/542,550, filed on Nov. 15, 2014, now Pat. No. 9,350,126, and a continuation-in-part of application No. 14/497,205, filed on Sep. 25, 2014, now Pat. No. 9,472,910, application No. 15/292,138, which is a continuation-in-part of application No. 14/477,889, filed on Sep. 5, 2014, application No. 15/292,138, which is a continuation-in-part of application No. 14/454,737, filed on Aug. 8, 2014, application No. 15/292,138, which is a continuation-in-part of application No. 14/337,180, filed on Jul. 21, 2014, now Pat. No. 9,318,853, application No. 15/292,138, which is a continuation-in-part of application No. 14/517,941, filed on Oct. 20, 2014, now Pat. No. 9,496,662.

(60) Provisional application No. 62/021,066, filed on Jul. 4, 2014, provisional application No. 62/002,934, filed on May 26, 2014, provisional application No. 62/026,046, filed on Jul. 18, 2014, provisional application No. 62/035,472, filed on Aug. 10, 2014, provisional application No. 61/977,115, filed on Apr. 9, 2014, provisional application No. 61/940,815, filed on Feb. 17, 2014, provisional application No. 61/943,310, filed on Feb. 22, 2014, provisional application No. 61/949,232, filed on Mar. 6, 2014, provisional application No. 61/917,363, filed on Dec. 18, 2013, provisional application No. 61/926,270, filed on Jan. 11, 2014, provisional application No. 61/916,147, filed on Dec. 14, 2013, provisional application No. 61/919,681, filed on Dec. 20, 2013, provisional application No. 61/875,096, filed on Sep. 8, 2013, provisional application No. 61/863,896, filed on Aug. 8, 2013, provisional application No. 61/866,037, filed on Aug. 14, 2013, provisional application No. 61/867,584, filed on Aug. 19, 2013, provisional application No. 61/856,077, filed on Jul. 19, 2013, provisional application No. 61/857,687, filed on Jul. 23, 2013, provisional application No. 61/899,276, filed on Nov. 3, 2013.

(51) Int. Cl.
*H01R 13/405* (2006.01)
*H01R 107/00* (2006.01)

(58) Field of Classification Search
USPC ..... 439/660, 626, 374, 377, 79, 733
See application file for complete search history.

(56) References Cited

U.S. PATENT DOCUMENTS

| | | | | |
|---|---|---|---|---|
| 8,087,944 | B2 | 1/2012 | Kumamoto et al. | |
| 8,517,773 | B2 | 8/2013 | Lee et al. | |
| 8,968,031 | B2 | 3/2015 | Simmel et al. | |
| 9,281,642 | B1 | 3/2016 | Tseng et al. | |
| 9,300,095 | B2 | 3/2016 | Lin et al. | |
| 9,312,641 | B2 | 4/2016 | Wang et al. | |
| 9,318,856 | B2 | 4/2016 | MacDougall et al. | |
| 9,350,126 | B2 * | 5/2016 | Little | H01R 24/60 |
| 9,356,400 | B2 * | 5/2016 | Little | H01R 4/023 |
| 9,379,499 | B2 | 6/2016 | Miyoshi et al. | |
| 9,490,594 | B2 * | 11/2016 | Little | H01R 24/60 |
| 2007/0049100 | A1 | 3/2007 | Tsai | |
| 2009/0156027 | A1 | 6/2009 | Chen | |
| 2013/0095702 | A1 | 4/2013 | Golko et al. | |
| 2014/0024257 | A1 | 1/2014 | Castillo et al. | |
| 2015/0162684 | A1 | 6/2015 | Amini et al. | |
| 2015/0171562 | A1 | 6/2015 | Gao et al. | |
| 2015/0214673 | A1 | 7/2015 | Gao et al. | |
| 2015/0214674 | A1 | 7/2015 | Simmel et al. | |
| 2015/0295362 | A1 | 10/2015 | Tziviskos et al. | |
| 2015/0340813 | A1 | 11/2015 | Ng et al. | |
| 2015/0340815 | A1 | 11/2015 | Gao et al. | |
| 2015/0340825 | A1 | 11/2015 | Ng et al. | |
| 2016/0118752 | A1 | 4/2016 | Guo et al. | |

FOREIGN PATENT DOCUMENTS

| | | | |
|---|---|---|---|
| CN | 2454802 | Y | 10/2001 |
| CN | 2724249 | Y | 9/2005 |
| CN | 2728006 | Y | 9/2005 |
| CN | 201029143 | Y | 2/2008 |
| CN | 201107821 | Y | 8/2008 |
| CN | 201230066 | Y | 4/2009 |
| CN | 101573840 | A | 11/2009 |
| CN | 201741935 | U | 2/2011 |
| CN | 201741937 | U | 2/2011 |
| CN | 201868687 | U | 6/2011 |
| CN | 102437482 | A | 5/2012 |
| CN | 102544812 | A | 7/2012 |
| CN | 202423735 | | 9/2012 |
| CN | 202513384 | U | 10/2012 |
| CN | 202737282 | | 2/2013 |
| CN | 103081253 | A | 5/2013 |
| CN | 203242848 | U | 10/2013 |
| CN | 103427263 | A | 12/2013 |
| CN | 203326282 | U | 12/2013 |
| CN | 203481540 | U | 3/2014 |
| TW | M288035 | | 2/2006 |
| TW | M357077 | | 5/2009 |
| TW | M391213 | | 10/2010 |
| TW | I427870 | | 6/2011 |
| TW | M414692 | | 10/2011 |
| TW | M443957 | | 12/2012 |
| TW | M453995 | | 5/2013 |
| TW | M454654 | | 6/2013 |
| TW | M471688 | | 2/2014 |
| WO | WO2009147791 | | 12/2009 |
| WO | WO2013/020359 | | 2/2013 |

OTHER PUBLICATIONS

USB Type-C Specification 0.9c05—20140518, p. 24-44,47,53-64,84-86.

Universal Serial Bus Type-C Cable and Connector Specification Revision 1.0 Aug. 11, 2014, p. 18-19,28-48,51,55,58,59-63,65-67,70,93,96-99.107,110-113.

* cited by examiner

FLIPPABLE ELECTRICAL CONNECTOR

CROSS REFERENCE TO CROSS REFERENCE TO RELATED APPLICATIONS

This application is a continuation in part of application Ser. No. 15/169,004 filed on May 31, 2016, the contents of which are incorporated entirely herein by reference.

BACKGROUND OF THE INVENTION

1. Field of the Invention

The present invention relates to an electrical connector, and more particularly to a flippable plug connector used with a receptacle connector.

2. Description of Related Art

USB 3.0 Promoter Group issues a new specification which establishes a new type connector named as USB Type-C Cable and Connector, on Aug. 11, 2014. In the specification, the Type-C plug enhances ease of use by being plug-able in either upside-up or upside-down directions. The plug connector connecting with a cable defines two types, one type is USB Full-Featured Type-C Plug Interface with 22 pins, another type is USB 2.0 Type-C plug with 14 pins. The plug connector is connected to the cable via paddle card, which will enhance the whole cost of the cable connector.

Hence, a new and simple electrical plug connector and is desired to improve those disclosed in the aforementioned proposal.

SUMMARY OF THE INVENTION

Accordingly, the object of the present invention is to provide to a plug connector, comprises a connector body defining a front mating port and a rear cable supporting platform with opposite first and second surfaces, a plurality of terminals and a cable. The terminal comprising a pair of USB 2.0 signal soldering legs, a grounding soldering leg and a power soldering leg exposed to the first surface of the supporting platform, and a detecting soldering leg, an additional power soldering leg and an additional grounding soldering leg exposed to the second surface of the supporting platform. The cable with a plurality of wires consisting of a pair of USB 2.0 signal wires, a power wire, a grounding wire welded with corresponding soldering legs on the first surface of the supporting platform. The second surface of the supporting platform is further located with a SMT type resistor with a first leg and a second leg, the first leg is connected with the detecting soldering leg, the second leg is connected with the additional power soldering leg or the additional grounding soldering leg on the second surface of the platform.

Other objects, advantages and novel features of the invention will become more apparent from the following detailed description when taken in conjunction with the accompanying drawings.

DETAILED DESCRIPTION OF THE PREFERRED EMBODIMENT

Figure 1:
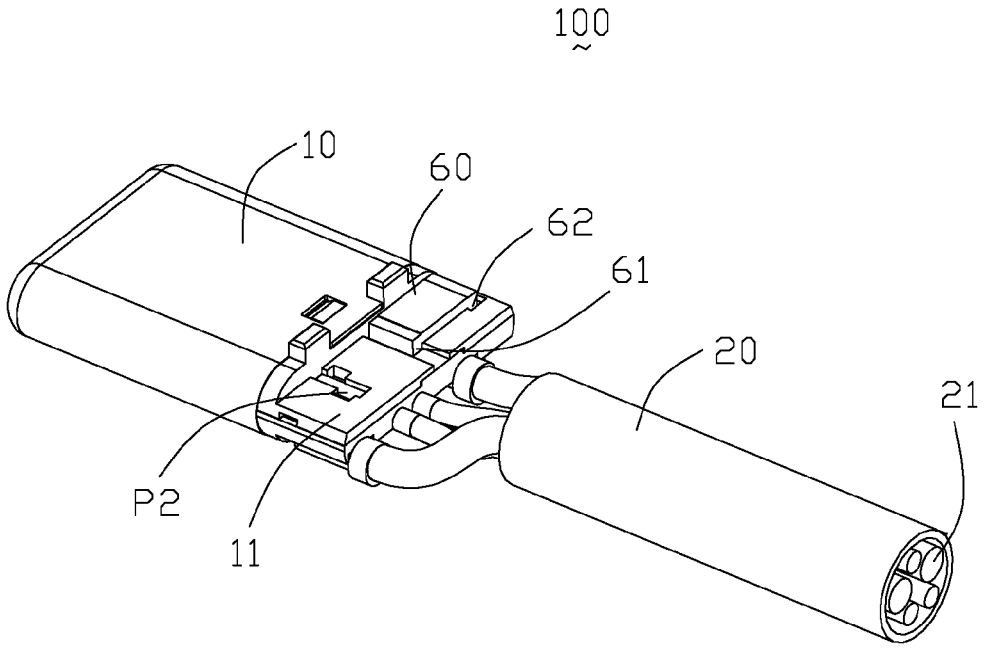
FIG. 1 is an assembled perspective view of a plug connector connecting with a cable of a preferred embodiment of the instant invention.

Reference will now be made in detail to the preferred embodiment of the present invention.

Referring to FIG. 1 through FIG. 8, a USB 2.0 Type C plug connector 100 of a preferred embodiment of this present invention is illustrated, which defines a front connector body 10 and a rear cable 20. The connector body 10 has a row of first terminals 31 and a row of second terminals 41, the connector body 10 further defines a cable supporting platform 11 with a first surface 110 and a second surface 111 opposite to the first surface 110. Soldering legs of the first and second terminals extend to the platform 11 and are welded to wires 21 of the cable. The connector body 10 comprises an insulative housing (not labeled) defining a mating cavity opening forwards, a metallic shell surrounding the insulating housing and the two rows of the terminals in the housing. Each row of terminals is inserted molded in an insulator to form a terminal module. Two terminal modules sandwiched with a metallic latch 50 are inserted into the housing.

Figure 5:
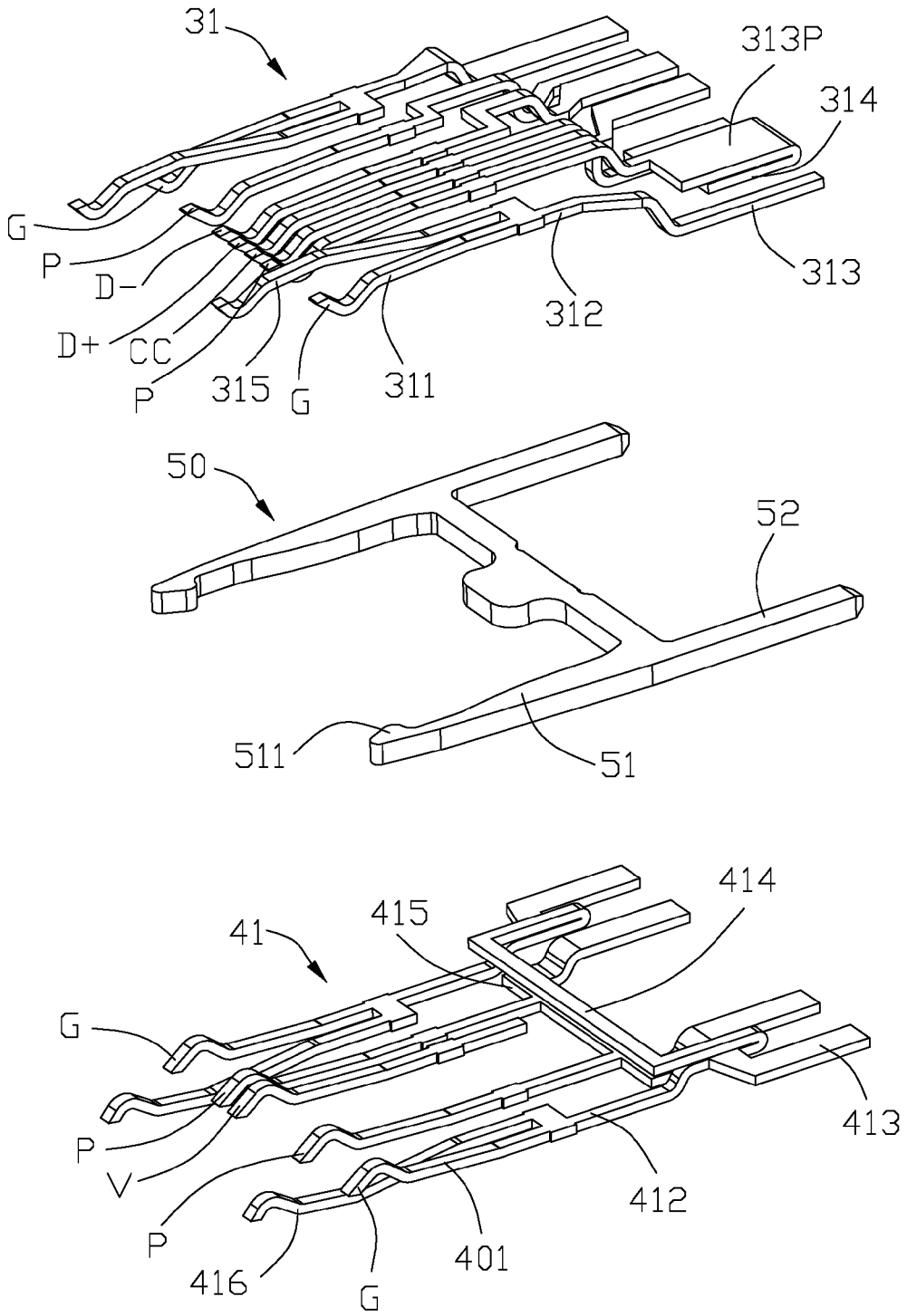
FIG. 5 is a front and top exploded perspective view of two rows of terminals and the latch shown in FIG. 4.
Figure 6:
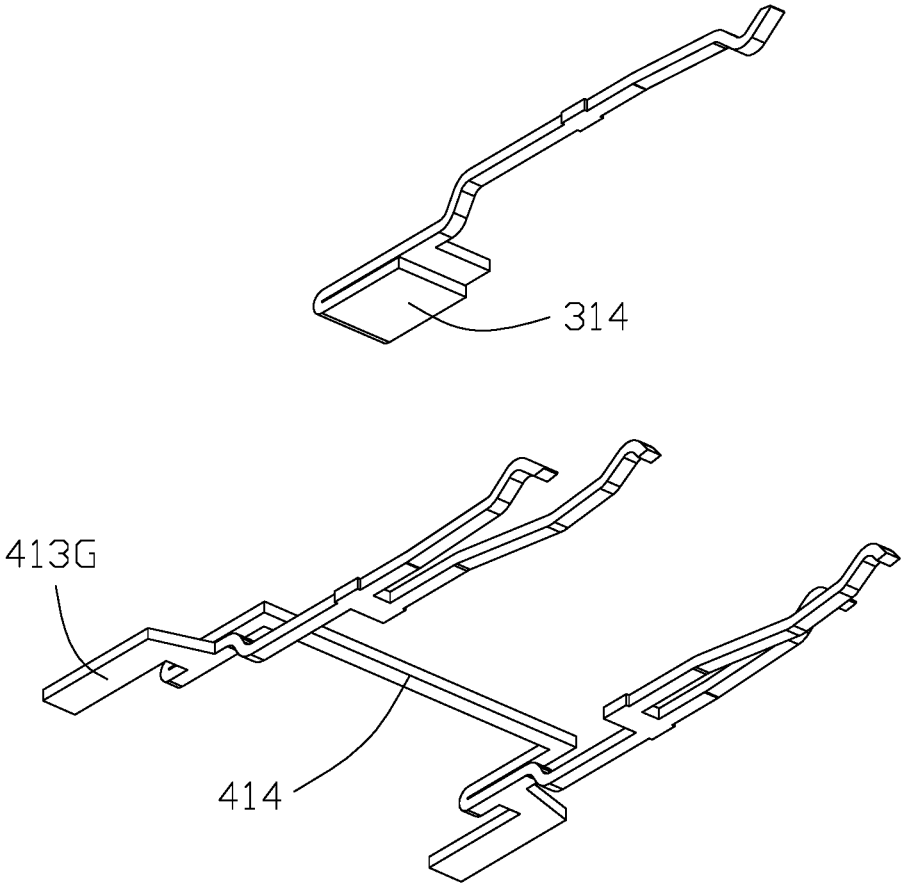
FIG. 6 is an exploded perspective view of a power terminal and two grounding terminals shown in FIG. 5.

Referring to FIGS. 5 and 6, the first/upper terminals 31 consist of seven terminals compliant to USB 2.0 Type C pin assignment, a pair of grounding terminals G, a pair of power terminals P, a pair of signal terminals (D+, D−) and a CC detecting terminal CC located beside the pair of signal terminals. Each first terminal 31 comprises a contacting section 311 extending into the mating cavity, a leg section 313 extending forwards and a middle section 312 connecting with the contacting section 311 and the leg section 313. Furthermore, an additional leg section 314 extends from a distal end of the leg section 313P of the power terminal P, the additional leg section 314 is located under the leg section 313P. An additional contacting section 315 extends forwards from the middle section 312 of each grounding terminal G.

The second terminals 41 consist of four terminals compliant to the USB 2.0 Type C, a pair of grounding terminals G and a pair of power terminals P. An additional detecting terminal Vconn is added in the second row in this embodiment, which only has a contacting section without a leg section, so that the terminal has no function and can be omitted. Each second terminal 41 comprises a contacting section 411 extending in to the mating cavity, a leg section 413 extending forwards and a middle section 412 connecting with the contacting section 411 and the leg section 413. The pair of grounding terminals are jointed together via a first bridge section 414, the leg section 413G sidely extends from a distal end of the middle section 412, the first bridge section 414 directly extends from the distal end of the middle section 412. The U shaped first bridge 414 then folds forwards and under the middle section 412. The pair of power terminals P are jointed together via a second bridge section 415 bridged between the middle sections 412. Furthermore, an additional contacting section 416 extends forwards from the middle section 412 of each grounding terminal G.

The H shaped latch 50 comprises a pair of side arms 51 with locking heads 511 protruding into the mating cavity and a pair of leg sections 52 extending rearwards.

Figure 3:
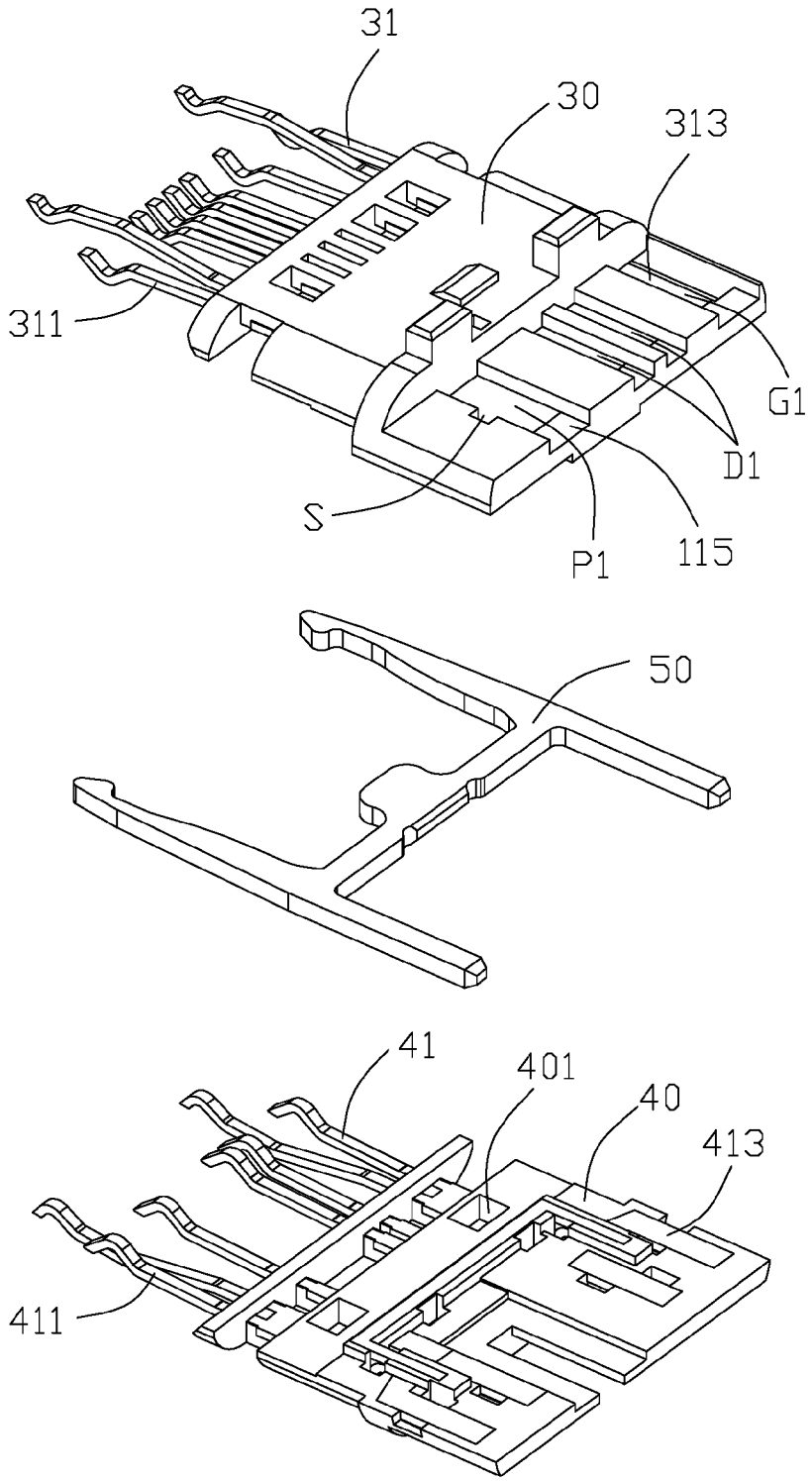
FIG. 3 is a rear and top explode perspective view of two terminal modules and a metallic latch of the plug connector shown in FIG. 2.
Figure 4:
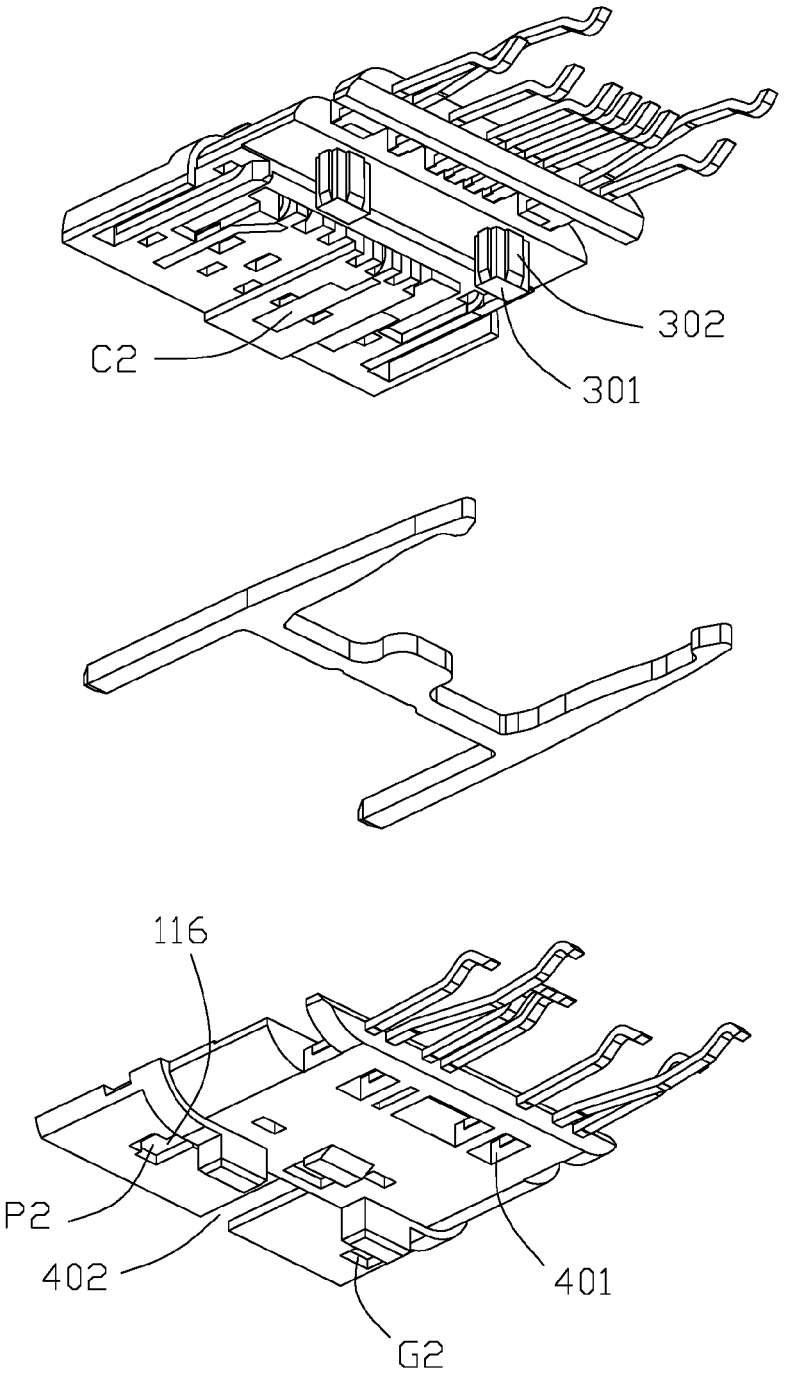
FIG. 4 is a bottom and front explode perspective view of two terminal modules and the metallic latch of the plug connector shown in FIG. 3.
Figure 7:
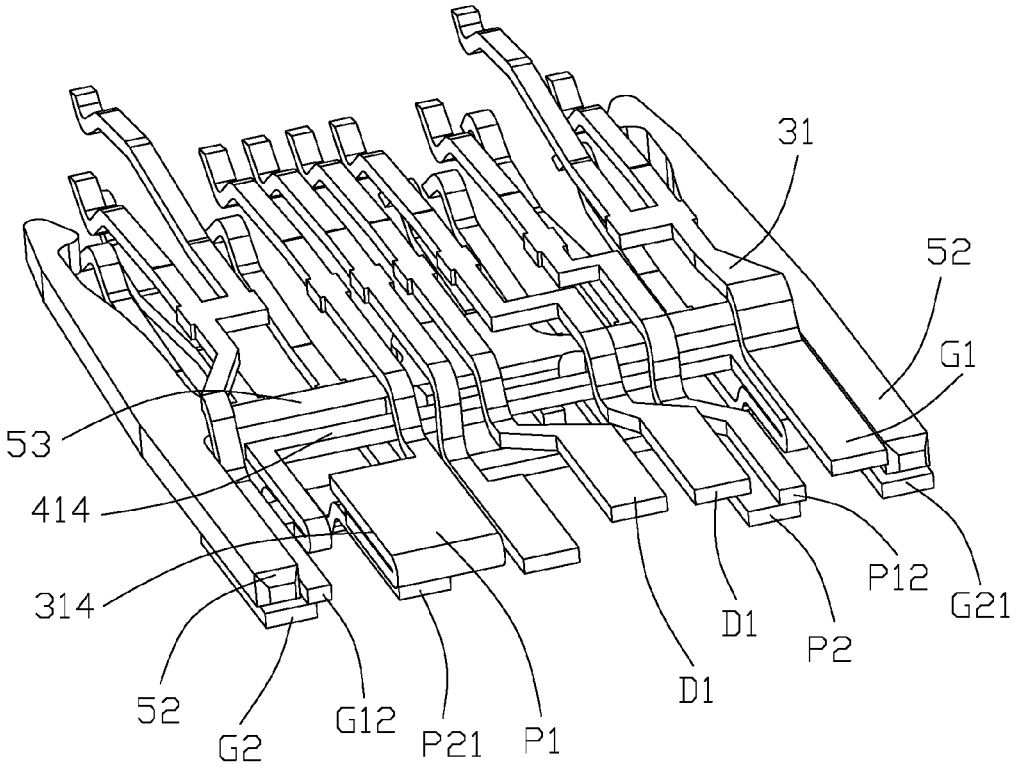
FIG. 7 is a rear and top perspective view of the two rows of terminals and the metallic latch.
Figure 8:
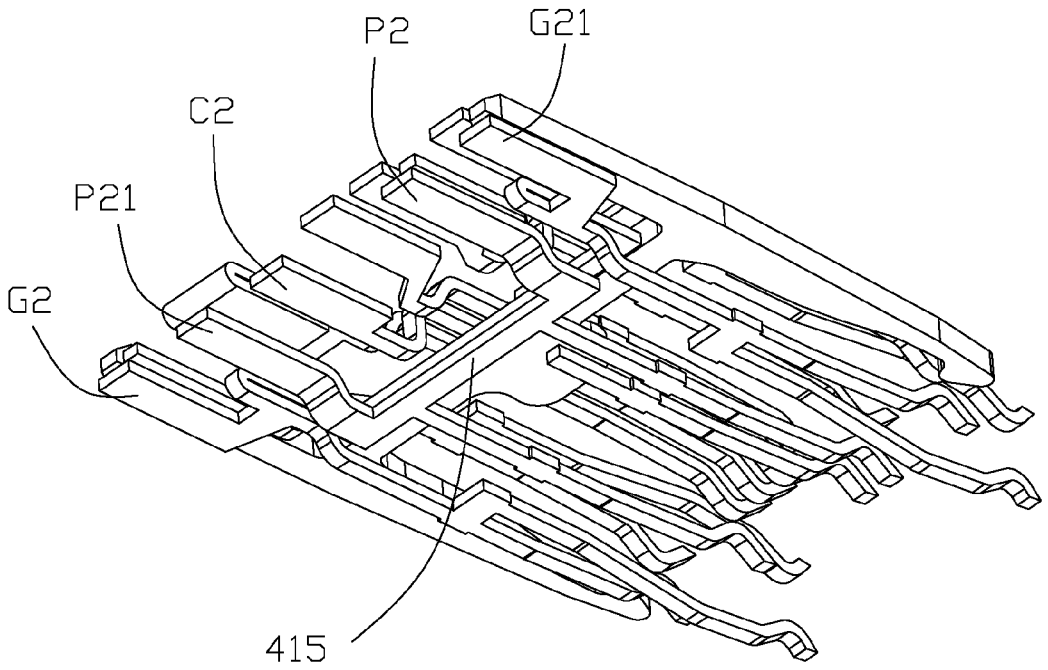
FIG. 8 is a bottom and rear perspective view of the two rows of terminals and the metallic latch.

Referring to FIGS. 7 and 8, the pair of the signal leg sections D1 of the signal terminals, one power leg section P1 and one grounding leg section G1 of the first terminals 31, are arranged in a same plane, i.e., in the first surface 110 of the platform 10, said leg sections upon the first surface 110 are attended to be welded to the wires of the cable and functioned as soldering legs. The leg sections C2 of the detecting terminal CC of the first terminals 31 bend upon the second surface 111 of the platform 10. The grounding leg section G2, the power leg section P2 of the second terminals 41 are arranged upon a same plane, i.e., upon the second surface 111 of the platform 11, said leg sections upon the second surface 111 are attended to be welded wires of the cable or a resister 60 and functioned as additional soldering legs. Therefore, the soldering legs on the first surface 111 consist of the pair of signal soldering leg D1, one power soldering leg P1 and one grounding soldering leg G1, the pair of the signal soldering legs is located between the power soldering leg and the grounding soldering leg. The additional soldering legs on the second surface consist of one detecting soldering leg C2, one additional power soldering leg P2 and one additional grounding soldering leg G2, the detecting soldering leg C2 is located between the additional power soldering leg P2 and the additional grounding solder leg G2. The other leg sections G12, G21 and the leg sections 52 of the latch are electrically connecting with each other. The first grounding leg section G12, G1 and the leg section 52 are abutted against each other side by side, the second grounding leg section G21, G2 and the leg section 52 are stacked with each other in a vertical direction. In this preferred embodiment, the leg sections G2 of the second grounding terminals might widen slightly so as to align with the leg sections G12 of the first grounding terminal, thereby ensure the stacked engagement of the leg sections and the leg sections 52 of the latch. The first bridge section 414 folds forwards and touch a rear edge of the beam 53. Referring to FIG. 1, the SMT type resistor 60 does not protrude beyond the connector body in the vertical direction. Referring to FIG. 3, the power soldering leg and the grounding soldering leg are widen than the signal soldering legs D1 so as to transmit a larger power. Referring to FIGS. 3 and 4, the first and second surfaces further defines a plurality of recesses 115, 116 to receive corresponding soldering legs one by one. The recesses 115 receiving the signal soldering legs, the power soldering leg, the grounding soldering leg and the detecting soldering leg rearwards run through the platform 11. The two recesses 116 receiving the additional power and grounding soldering legs is not through the platform, the flat legs 61, 62 of the resistor 60 are receiving in the recesses 116 and limited in the recesses in a front and rear direction, so as to pre-position of the resistor 60.

In this embodiment, the two power/grounding terminals in the same row are transversely connected with a bridge section, the two power/grounding terminals in different rows are abut against each other. The first row has more terminals than the second row, so that the additional leg 314 extends from the first row and the bridge sections are disposed between the power/grounding terminals of the second row. The second bridge section 415 is linear while the first bridge section 414 is in a U shape, the first bridge section extend rearwards and behind the leg section, and then folded forwards to void interference with the power terminals and short the length of the platform in a front and rear direction.

Referring to FIGS. 3 and 4, the first terminals 31 are inserting molded with the first insulator 30, the second terminals 41 are inserting molded with the second insulator, the contacting sections 311, 411 extend forwards beyond the insulators. The first insulator 30 defines retaining posts 301 with vertical ribs 302 on an outer periphery of the posts 301, the retaining posts 301 are inserted and retained in corresponding retaining holes 401. The surfaces of the leg sections G12, G21, P12, P21 are exposed to and flushed with the inner surface of the insulators. When the two insulators are assembled together, the leg sections are stacked with each other. The platform 22 further intentionally defines some tine slits S beside the power soldering leg and the grounding soldering leg so as to allow solder material to be filled therein to join the corresponding leg sections, and to join the corresponding leg sections together when a soldering process is applied through a hot bar. The lower surface of the first insulator 30 protrudes downwards and the detecting soldering leg C2 is located at the protruding portion which are received in a recess 402 defined in the second insulator 40, so that the detecting soldering leg C2 exposes to the second surface 111 of the platform 11.

Figure 2:
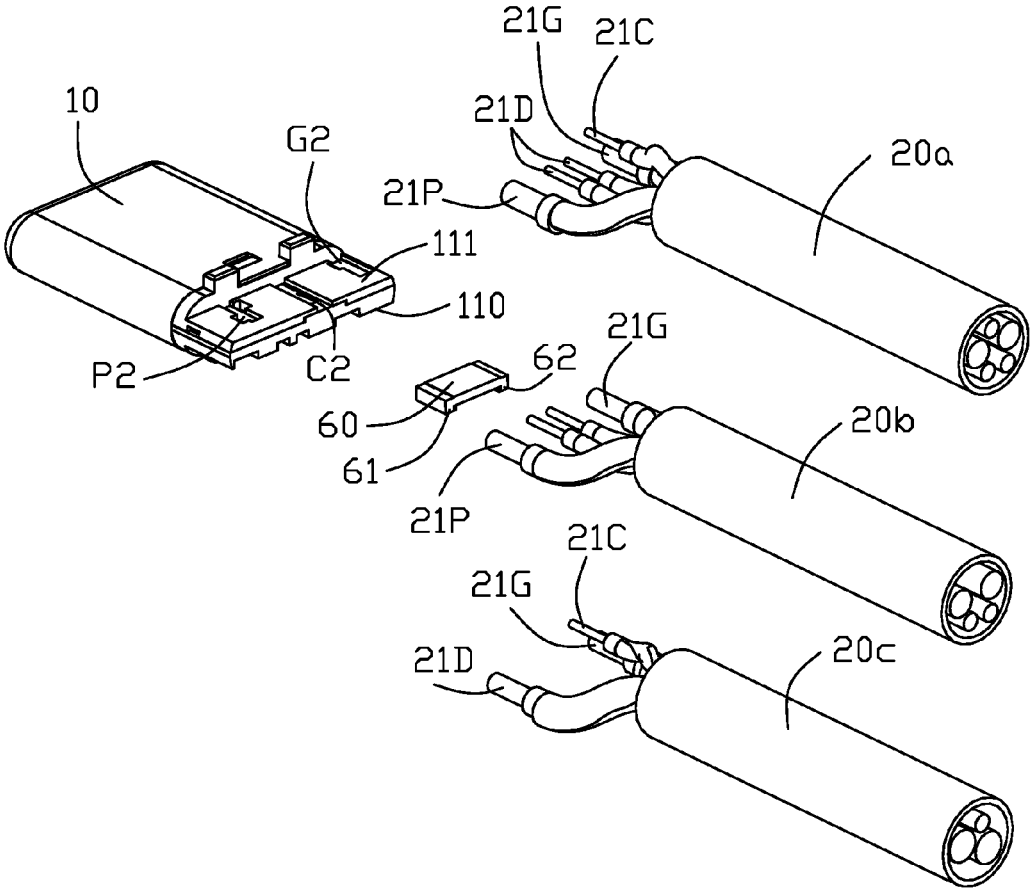
FIG. 2 is a perspective view of the plug connector shown in FIG. 1, which is alternatively connecting with one of three types of cables.

Referring to FIGS. 1 and 2, the leg sections exposed upon the first and second surfaces of the platform named as soldering legs, are intended to connecting with wires of the cable 20 or other electronic element such as a resistor 60. The first surface 110 of the platform 10 is arranged with four soldering legs, the pair of signal soldering legs D1, the grounding soldering leg G1, the power soldering leg P1, the grounding and power soldering legs are located at opposite sides of the signal pair. The second surface 111 of the platform 10 is arranged with three soldering legs, the additional grounding soldering leg G2, the additional power soldering leg P2 and the detecting soldering leg C2 which located between the additional grounding and power soldering legs. The grounding soldering leg G1 is located at the left side of the first surface while the additional grounding soldering leg G2 is located at a right side of the second surface, the two soldering legs are staggered in the left and right direction.

Continuing to FIGS. 1 and 2, the plug connector 100 is alternatively connecting with one type cable of three types, that is, the plug connector is suitable for three different usages via connecting with different cables 20*a*, 20*b*, 20*c* and resistor.

The cable 20*a* of a first type includes a grounding wire 21G, a power wire 21P, a pair of USB 2.0 signal wires 20*d* and a CC detecting wire 21C, wherein the grounding wire, power wire and the two signal wires are arranged in one row and soldered with corresponding soldering legs on the first surface 110 of the platform 10, respectively. The detecting wire 21C is soldered with the detecting soldering leg C2 on the second surface 111 of the platform 10. Under this situation, the cable assembly is adapted for a USB Type C to USB Type C cable assembly.

The cable 20*b* of a second type includes a grounding wire 21G, a power wire 21P and a pair of USB 2.0 signal wires 21D, without the detecting wire 21C in the first type cable 20*a*. A resistor 60 with a first leg 61 and a second leg 62 is incorporated on the second surface 111. The first leg 61 is connected with the detecting soldering leg C2, the second leg 62 is connected with the additional power or grounding soldering leg. When the cable 20*b* is adapted for a USB Type C to USB Type A or B cable assembly, the second leg 62 are connected with the additional power soldering leg P2. When the cable 20*b* is adapted for a USB Type A or B to USB Type C cable assembly, the second leg 62 is connected with the additional grounding soldering leg G2.

The cable 21*c* of a third type includes a power wire 21P, a grounding wire 21G and a CC detecting wire 21C. The power and grounding wires are soldered with the power and grounding soldering legs on the first surface 110 of the platform 11, the detecting wire 21C is soldered with the detecting soldering leg C2 on the second surface 111 of the platform, to transit a larger power current up to five amperes.

However, the disclosure is illustrative only, changes may be made in detail, especially in matter of shape, size, and arrangement of parts within the principles of the invention.

What is claimed is:

1. A plug connector, comprising:

a connector body defining a front mating port and a rear cable supporting platform with opposite first and second surfaces;

a plurality of terminals comprising a pair of USB 2.0 signal soldering legs, a grounding soldering leg and a power soldering leg exposed to the first surface of the supporting platform, and a detecting soldering leg, an additional power soldering leg and an additional grounding soldering leg exposed to the second surface of the supporting platform;

a cable with a plurality of wires consisting of a pair of USB 2.0 signal wires, a power wire, a grounding wire welded with corresponding the pair of USB 2.0 signal soldering legs, power soldering leg and grounding soldering leg on the first surface of the supporting platform, respectively;

wherein the second surface of the supporting platform is further located with a SMT type resistor with a first leg and a second leg, the first leg is connected with the detecting soldering leg, the second leg is connected with the additional power soldering leg or the additional grounding soldering leg on the second surface of the platform;

wherein said additional power soldering leg is diagonally located with regard to and electrically connected to the power soldering leg, and said additional grounding leg is diagonally located with regard to and electrically connected to the grounding soldering leg;

wherein no wires are soldered upon said additional power soldering leg and said additional soldering leg;

wherein the power and grounding soldering legs are widen than the USB 2.0 signal soldering legs in a transverse direction;

wherein the first surface of the platform defines four recesses accommodating with corresponding soldering legs; the second surface of the platform defines three recesses accommodating with corresponding soldering leg.

2. The plug connector as claimed in claim 1, wherein the corresponding soldering legs run rearwards through a rear edge of the platform; one recess receiving the detecting soldering leg runs rearwards through the rear edge of the platform, two recesses receiving the additional power and grounding soldering leg respectively do not run through the rear edge of the platform.

3. The plug connector as claimed in claim 2, wherein the SMT type resistor does not protrude beyond the connector body in a vertical direction.

4. A plug connector comprising:

an insulative housing defining a front mating cavity and a rear cable supporting platform with opposite first and second supporting surfaces;

a plurality of first terminals and second terminals comprising contacting sections located at opposite sides of the mating cavity and soldering legs exposed to the supporting platform;

wherein the first supporting surface defines four recesses through a rear edge of the supporting platform and the recesses respectively accommodating with two USB 2.0 signal soldering legs, a power soldering leg and a grounding soldering leg; the second supporting surface defines a recess through the rear edge of the supporting platform and accommodating with a detecting soldering leg and two closed recesses accommodating with an additional power soldering leg and an additional second grounding soldering leg;

wherein the power and grounding soldering legs are widen than the USB 2.0 signal soldering legs in a transverse direction;

further including a cable, wherein the cable consists of a pair of USB 2.0 signal wires, a grounding wire and a power wire welded with corresponding pair of USB 2.0 soldering legs, grounding soldering leg and power soldering legs on the first surface of the platform, and a detecting wire welded with the detecting soldering leg on the second surface of the platform, the additional power and grounding soldering legs are unused.

5. A plug connector comprising;

a housing defining a front mating cavity and a rear cable supporting platform with opposite first and second supporting surfaces;

a row of first terminals and a row of second terminals, comprising contacting sections located at opposite sides of the mating cavity and soldering legs exposed to the supporting platform, each row at leastly comprising two power terminals and two grounding terminals;

wherein the row of first terminals comprises a pair of USB 2.0 signal terminals, two grounding terminals, and two power terminals and a detecting terminal, each of first terminals comprises a contacting section and a leg section extending from the contacting section;

wherein the row of second terminals comprises two grounding terminals and two power terminals, each of the second terminals comprising a contacting section and a leg section extending from the contacting section:

wherein two grounding terminals of the second terminals are transversely connected by a U shape first bridge section, the first bridge section extends rearwards and then folded forwards, and two power terminal of the second terminals are transversely connected by a linear second bridge section;

wherein the two grounding terminals of the first terminal are electrical connecting with the two grounding terminals of the second terminals, the two power terminals of the first terminal are stacked with the two second grounding terminals of the second terminals in a vertical direction.

6. The plug connector as claimed in claim 5, comprising an H-shaped metallic latch, wherein the latch comprises a pair of latching arms with a hook protruding into the front mating cavity and leg connecting with the grounding soldering leg.

7. The plug connector as claimed in claim 5, wherein the first and second supporting surfaces defines tine slits beside power terminals and the grounding terminal.

* * * * *